US007111544B2

(12) United States Patent
Kohlstedt et al.

(10) Patent No.: US 7,111,544 B2
(45) Date of Patent: Sep. 26, 2006

(54) ARTILLERY GUN WITH A HEAVY WEAPON ARRANGED ON A SUPPORT VEHICLE

(75) Inventors: Michael Kohlstedt, Immenhausen (DE); Heinz-Jürgen Schlömer, Witzenhausen (DE); Heinrich Heldmann, Kassel (DE); Lars Schneider, Naumburg (DE); Ernst Reiting, Schauenburg (DE); Peter Liebel, Kassel (DE)

(73) Assignee: Krauss-Maffei Wegmann GmbH & Co. KG, (DE)

( * ) Notice: Subject to any disclaimer, the term of this patent is extended or adjusted under 35 U.S.C. 154(b) by 254 days.

(21) Appl. No.: 10/488,409

(22) PCT Filed: Aug. 21, 2002

(86) PCT No.: PCT/DE02/03047

§ 371 (c)(1),
(2), (4) Date: Mar. 18, 2004

(87) PCT Pub. No.: WO03/025494

PCT Pub. Date: Mar. 27, 2003

(65) Prior Publication Data

US 2004/0216597 A1 Nov. 4, 2004

(30) Foreign Application Priority Data

Aug. 30, 2001 (DE) ..... 101 42 565

(51) Int. Cl.
*F41A 9/38* (2006.01)

(52) U.S. Cl. ..... 89/46

(58) Field of Classification Search ..... 89/45, 89/46, 47

See application file for complete search history.

(56) References Cited

U.S. PATENT DOCUMENTS

| | | | | |
|---|---|---|---|---|
| 4,947,728 | A * | 8/1990 | Muhlhausen et al. | 89/46 |
| 4,966,064 | A * | 10/1990 | Kaustrater et al. | 89/46 |
| 5,054,367 | A * | 10/1991 | Heldmann et al. | 89/46 |

FOREIGN PATENT DOCUMENTS

| | | | | |
|---|---|---|---|---|
| DE | 36 42 920 | A1 * | 6/1988 | 89/46 |
| DE | 37 19 298 | | 12/1988 | |
| DE | 40 14 192 | | 11/1991 | |
| DE | 40 14 195 | | 11/1991 | |
| DE | 44 26 607 | | 2/1995 | |
| EP | 0 331 980 | | 9/1989 | |
| EP | 0 723 905 | | 7/1996 | |

(Continued)

*Primary Examiner*—Stephen M. Johnson
(74) *Attorney, Agent, or Firm*—Robert W Becker & Associates; Robert W Becker

(57) ABSTRACT

An artillery gun having a weapon disposed on a carrier vehicle is provided and comprises a first module, containing the weapon and mounted on a gun mount and also containing at least a portion of an automatic projectile feed mechanism. A second module contains further portions of the projectile feed mechanism. A standby member disposed to the rear of a projectile transporter of the feed mechanism is displaceably guided and can be disposed in a transfer position parallel to a charger disposed on a free end of a projectile transfer arm of the first module. A third module is provided and is embodied as a munitions magazine in which are stored upright projectiles that are adapted to be grasped via a projectile transporter and, accompanied by rotation and alignment, are conveyed via the standby member and charger into a region at the rear of the end of the weapon and to be raised into a loading position. At least one fourth module forms the carrier vehicle.

6 Claims, 15 Drawing Sheets

FOREIGN PATENT DOCUMENTS

| | | |
|---|---|---|
| FR | 2 011 747 | 3/1970 |
| FR | 2 605 095 | 4/1988 |
| FR | 2 613 061 | 9/1988 |

* cited by examiner

ARTILLERY GUN WITH A HEAVY WEAPON ARRANGED ON A SUPPORT VEHICLE

BACKGROUND OF THE INVENTION

The present invention relates to an artillery gun having a heavy weapon that is disposed on a carrier vehicle. Such an artillery gun is described in the European patent EP 0 331 980 B1 in an embodiment as an armored howitzer. This armored howitzer has a carrier vehicle that is embodied as a tracked vehicle, with a rotatable turret that is disposed behind the center of the vehicle and on which is disposed a heavy weapon that is pivotable in elevation. Disposed within the vehicle, in the region of the center of the vehicle, are projectile magazines in which the projectiles are upright relative to the base of the vehicle, while leaving free a passageway that extends essentially in the longitudinal direction of the vehicle. An automatic projectile feed mechanism is present via which a respective projectile is grasped out of the projectile magazine and, accompanied by rotation and orientation, is conveyed in the longitudinal direction of the vehicle into the region behind the end of the weapon, and there, accompanied by orientation in azimuth and elevation to the direction of the weapon at any given time, is raised into the loading position. The projectile feed mechanism has a projectile transfer arm that is pivotably mounted on the trunnion of the weapon and is moveable, independently of the as a ramming device being disposed on the free end of the transfer arm in the region behind the weapon. In the raised position of the projectile transfer arm, the charger is aligned relative to the axis of the bore of the weapon, and in the lowered position of the projectile transfer arm is oriented in the vertical direction. Further portions of the automatic projectile feed mechanism are disposed in the interior of the vehicle, and in particular a projectile transporter having a transport arm on the end of which is disposed a pivotable gripping device, as well as a standby member that disposed behind it, is displaceably guided in a transport rail, and can be disposed in a transfer position parallel to the charger. By means of the projectile transporter, the projectiles are removed from a projectile magazine and, accompanied by rotation and orientation, are conveyed by the standby member and the charger into the region behind the end of the weapon and are raised into the loading position. Further details of the known artillery gun are described in the above-cited document.

This artillery gun, which is generally known and introduced under the characterization PzH 2000, has a transport mass of altogether 49 t, and cannot be divided for transport in such a way that the individual parts have a maximum transport weight of 27 t and can thus also be transported with medium-sized aircraft.

Proceeding from the armored howitzer described in the above-cited document, the object of the invention is to provide an artillery gun having a heavy weapon disposed on a carrier vehicle that on the whole has a lighter weight construction and in addition can be divided into numerous parts, without great expense, for transport with medium-sized aircraft.

SUMMARY OF INVENTION

The basic concept of the invention is to construct the artillery gun from a plurality of modules, at least one of which represents the carrier vehicle, and at least one of which contains the heavy weapon. Further modules contain components of the automatic projectile feed mechanism and the munitions magazines. The modules are constructed in such a way that at least some of them can be assembled to form larger units in an easy to again separate form.

Pursuant to a first, basic embodiment, a total of four modules are connected to form a common unit. The first module contains the heavy weapon, which is pivotable in elevation, as well as a portion of the projectile feed mechanism, the second module contains further components of the projectile feed mechanism, the third module contains projectile magazines, and the fourth module forms the carrier vehicle and can represent a motor vehicle, of a known and used series, that is embodied as a wheeled vehicle having four axles.

However, it can also be embodied as a motor vehicle having chain mechanisms.

The first module is disposed on the second module so as to be rotatable in azimuth, which second module, together with the third module, is mounted on the carrier vehicle. Already in this embodiment, the artillery gun as a whole can have a much lighter construction than the known armored howitzer, thus making air transport possible. However, the modules can also be separated from one another. It has been shown to be advantageous with this embodiment if the first, second and third modules are connected to form a common unit, whereby a ground support unit, which in the platform of a carrier vehicle is extendable downwardly, is provided for the stabilization of the unit in the firing position. It can furthermore be advantageous if the first, second and third modules are placed as a common unit on the fourth module and are connected therewith, and the unit can be uncoupled from the fourth module, can be raised, and can be loaded separately from the fourth module, and can also be placeable on the ground in an independent manner by means of a ground support unit.

Pursuant to a further basic embodiment of the invention, some of the modules are respectively joined together to build two units that are separate from one another. Thus, the first module, which contains the weapon, is connected with the fourth module, which represents a carrier vehicle, to form a first unit, while the second and third modules are connected with a fifth module, which is also embodied as a carrier vehicle, to form a second unit. The modules that represent the carrier vehicles are again embodied as a motor vehicle, of a known type (GTK), that represents a wheeled vehicle having four axles. As will be explained in greater detail subsequently with the aid of specific embodiments, with this embodiment the first unit contains the weapon with a portion of the projectile feed mechanism, and the second unit contains the munitions magazines, possibly propellant charge magazines, as well as a further portion of the projectile feed mechanism. Pursuant to a first variant, the first unit can be embodied in such a way that the firing operation is effected directly from the carrier vehicle. In this case, the two units can be coupled together to form a common unit. However, a variant is also possible where, at the first unit, for accommodating the firing operation, the weapon is pivoted away from the carrier vehicle and is placed upon the ground. Details of this embodiment and its variants will be described further subsequently. Also with this fundamental embodiment, the weight of the two units can be limited such that air transport with medium-sized aircraft is possible.

BRIEF DESCRIPTION OF THE DRAWINGS

Embodiments for an artillery gun pursuant the invention will be explained in greater detail subsequently with the aid of the accompanying drawings.

The drawings show.

DESCRIPTION OF SPECIFIC EMBODIMENTS

As can be seen from FIGS. 1 to 4 of the drawings, the illustrated embodiment of an artillery gun is comprised of a total of four modules, which are indicated in the Figures with I to IV.

Module I contains a heavy weapon W, which is supported within the module I so as to be pivotable in elevation about a trunnion axis and that at its end is provided with a projectile delivery or transfer arm that is pivotable about the trunnion axis, can be moved in the plane of elevation, and that at its free end has disposed a charger L having a positioning or ramming device A. In the raised position of the projectile transfer arm Ü illustrated by way of example in FIG. 2, the charger L is aligned relative to the axis of the bore of the weapon W, and in the lowered position of the projectile transfer arm Ü illustrated by way of example in FIG. 3 is oriented in a vertical direction. The module I is equipped with a protective cover 3.2 as a ballistic protection, and is supported via its base plate 3.1 and via a turntable 3.3 upon the module II disposed below it.

Figure 2:
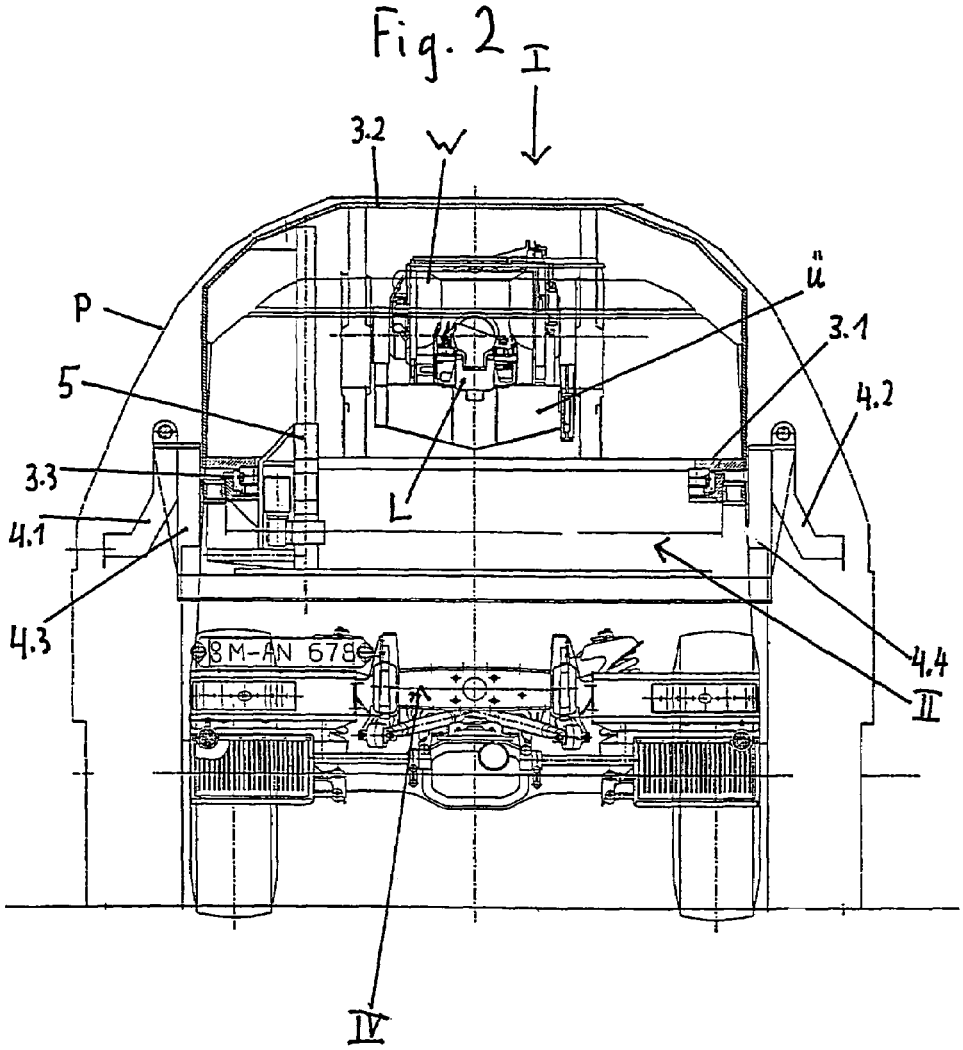
FIG. 2 a vertical cross-sectional view of the embodiment of FIG. 1 extending transverse to the longitudinal axis, in the region of the modules I and II with I lowered.
Figure 3:
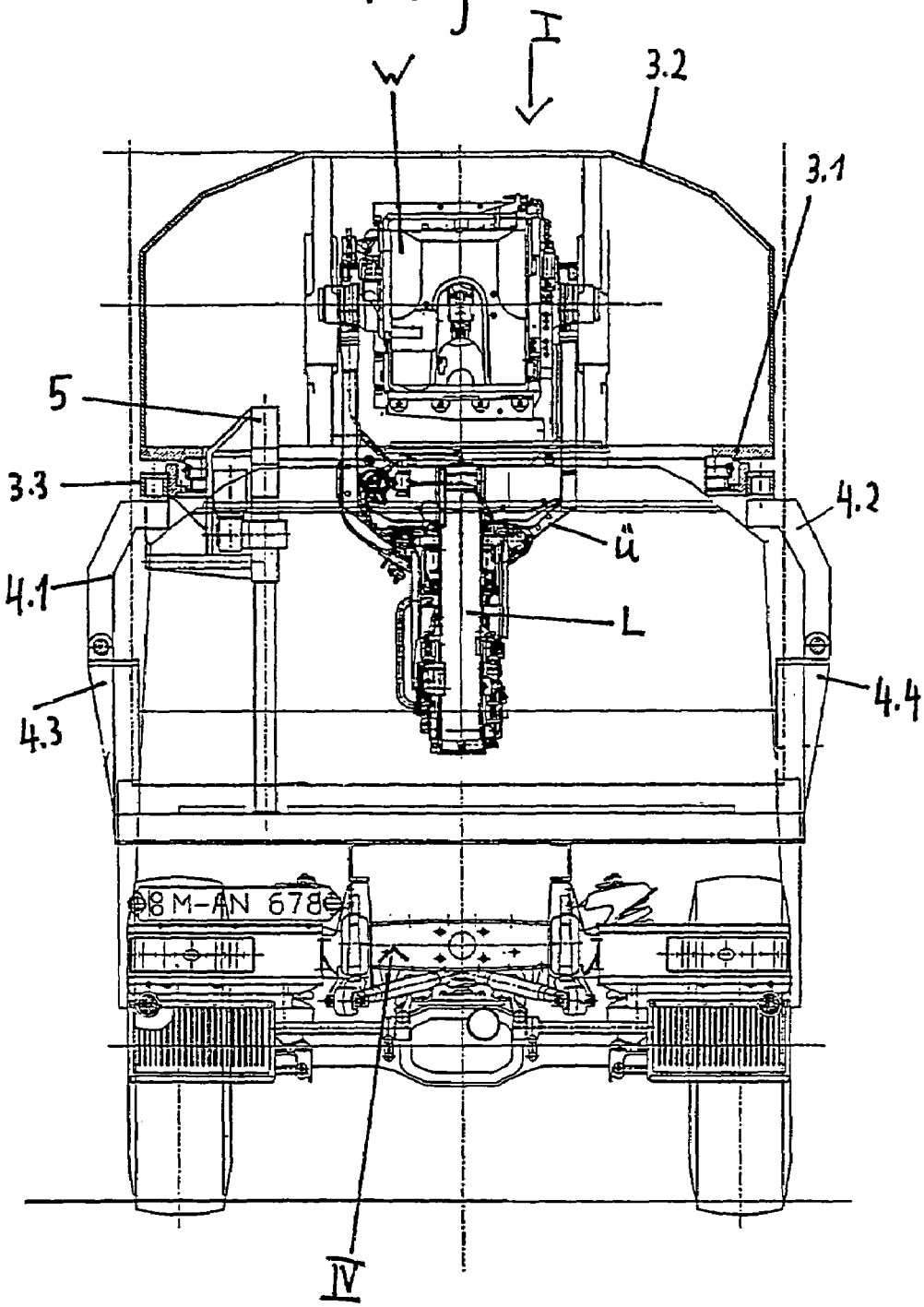
FIG. 3 in an illustration analogous to FIG. 2, the same cross-section with module I raised.

As can be seen from FIGS. 2 and 3, the module I can be moved out of the lowered transport position illustrated in FIG. 2 into a raised firing position illustrated in FIG. 3. A plurality of lifting apparatus 5 disposed in the region below the module I serve for the raising of the module I. These lifting apparatus 5 are mobile and after the raising of the module I out of the position of FIG. 2 into the position of FIG. 3 can be removed, so that the space within the module II below the module I is then entirely free for the pivoting of the projectile transfer arm Ü and the transport of the projectiles. As is furthermore visible from FIGS. 2 and 3, in the raised state of module I laterally arranged supports 4.1 and 4.2 for the support of module I upon the supports 4.3 and 4.4 of module II are pivoted in. After this support, the lifting apparatus 5 can be removed.

The modules II and III that are disposed below the module I, and which can be embodied as a common unit having a common housing, contain, in an only indicated manner, projectile magazines G1 and G2 as well as a projectile transporter G, which has a not separately illustrated transport arm, on the end of which is disposed a pivotable gripping device. By means of the projectile transporter G, the projectiles are grasped out of the projectile magazines G1 and G2, and accompanied by rotation and orientation are placed into a stand-by member B that is only indicated in FIG. 4 and that is displaceably guidable in a transport rail and, about a horizontal axis, can be pivoted upwardly into a vertical position, transverse to the direction of displacement, in which it can be disposed parallel to the charger L in the lowered state of the projectile transfer arm Ü, so that the projectile can be transferred out of the stand-by member B into the charger L and together with the projectile transfer arm Ü can be raised into the region behind the end of the weapon.

Details of this munition flow from the projectile magazines G1 and G2 to the region behind the weapon are described in detail in EP 0 331 980 B1 and proceed in the same manner as described there.

Figures 1, 1A:
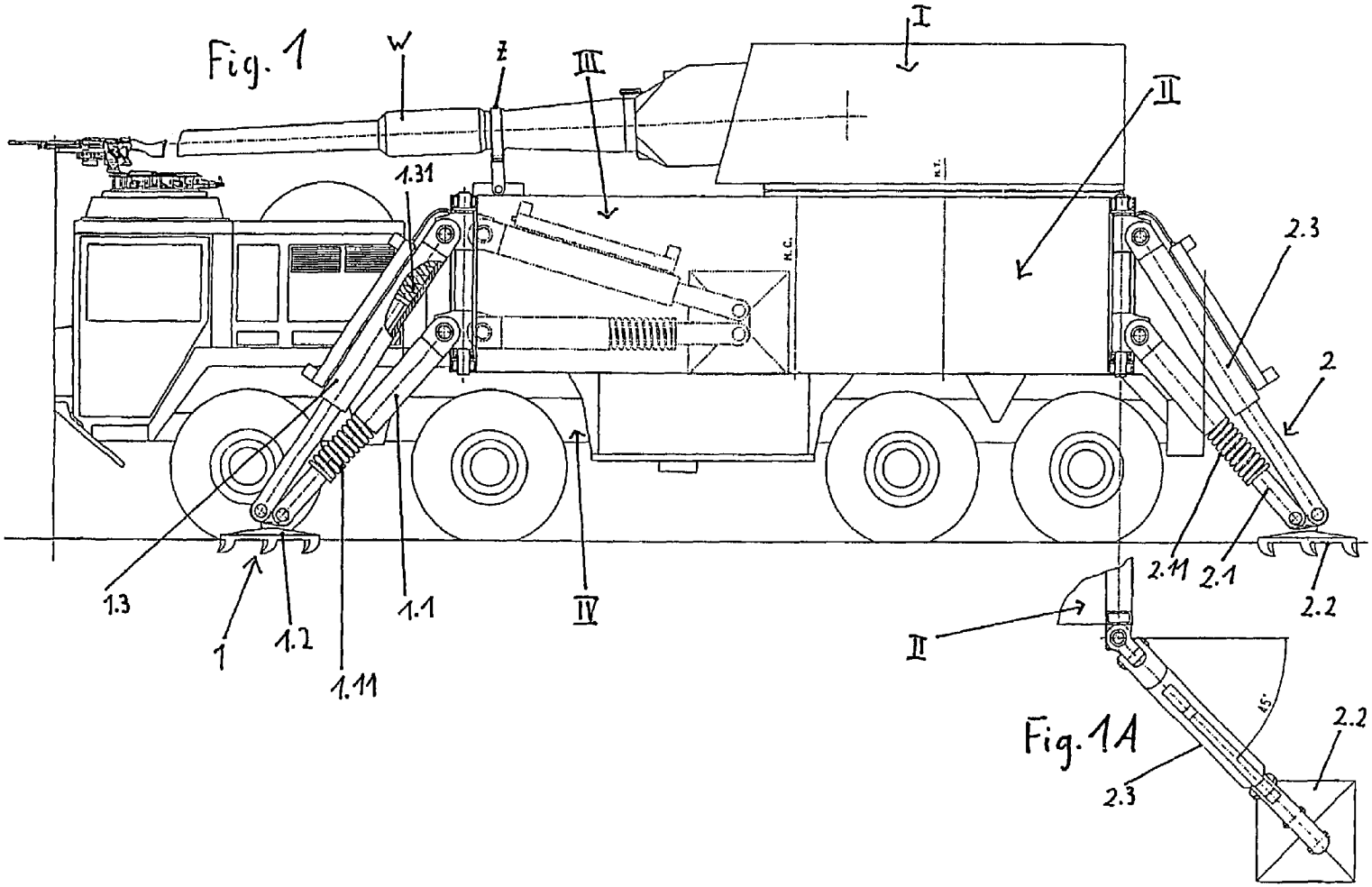
FIG. 1 a side view of a first embodiment of an artillery gun comprised of four modules combined to form a unit.
FIG. 1A a portion of the ground support unit of the artillery gun of FIG. 1, viewed from above.

The modules II and III are supported on the chassis of a module IV that, as can be seen from FIG. 1, forms the carrier vehicle and represents a motor vehicle of a known class that is embodied as a wheeled vehicle having four axles. So that during the firing operation, and in the raised position of module I (FIG. 3), an absolutely stable position of the artillery gun is ensured, and the recoil forces during the firing operation are not transmitted to the motor vehicle, a ground support unit 1 or 2 is provided in the platform of the carrier vehicle and can be extended downwardly. This ground support unit has four pivot arms, of which the pivot arms 1.1 and 2.1 are visible in FIG. 1. The pivot arm 1.1 is linked to the module III, and the pivot arm 2.1 is linked to the module II. At its free end, the pivot arm 1.1 carries a support plate 1.2, and the pivot arm 2.1 carries a support plate 2.2. In the pivoted down position illustrated in solid lines in FIG. 1, the support plates 1.2 and 2.2, as well as the remaining support plates, rest upon the ground. The raising and lowering of the pivot arms 1.1 and 1.2 is effected by means of hydraulic cylinders 1.3 and 2.3 respectively that are disposed above the pivot arms and are also linked to the modules III or II, and are respectively connected with the free ends of the pivot arms. Compression spring elements 1.11 or 2.11 and 1.31 are integrated not only into the pivot arms 1.1 and 2.1 but also into the hydraulic cylinders 1.3 and 2.3 for the absorption of the forces that occur during firing operation and for the return into the exact starting position for a subsequent firing.

As can be seen in FIG. 1, the pivot arms of the ground support unit are moveable out of the support position into a transport position that is illustrated by dot-dash lines in FIG. 1 for the pivot arm 1.1. For this purpose, they are raised into a horizontal position via the hydraulic cylinders, and each unit, which comprises pivot arm and hydraulic cylinder, is pivoted about a vertical axis V into an essentially horizontal position parallel to the side walls of the common housing of the modules III and II, which position is illustrated by dot-dash lines. The ground support unit can be arrested in the pivoted-down and in the pivoted-up positions.

FIG. 1A shows the support position from above by way of the pivot arm 2.1 with the hydraulic cylinder 2.3.

While driving and for transport, the weapon W can be connected to the module III via a clamping device Z.

Figures 1B, 1C:
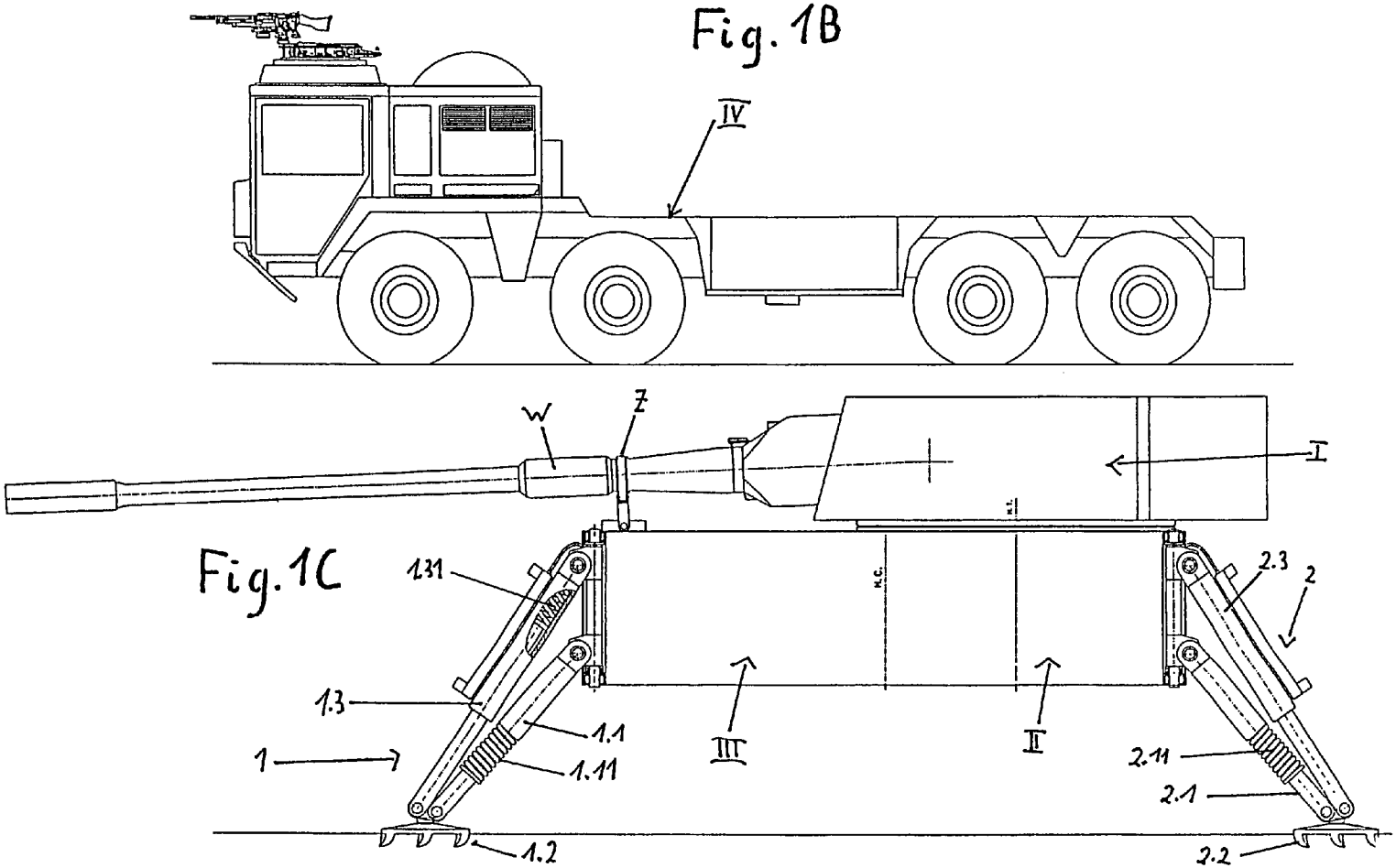
FIG. 1*b* in an illustration analogous to FIG. 1, module IV of the embodiment of FIG. 1.
FIG. 1C in an illustration analogous to FIG. 1, the modules I, II and III separated from module IV and placed on the ground.

FIGS. 1B and 1C show that the embodiment of the artillery gun of FIG. 1 can also be constructed in such a way that the modules I, II and III are connected to form a common unit that is supported upon the chassis of module IV and is coupled thereto. It is then possible to uncouple the unit comprising the modules I, II and III from the module IV. In this uncoupled state, the unit can either be separated from the module IV as a compact container structure and, with the ground support pivoted in, can, for example, be loaded into an aircraft, or it can also, as shown in FIG. 1C, with the aid of the ground support unit already described with the aid of FIGS. 1 and 1A, be freely placed on the ground.

Figure 4:
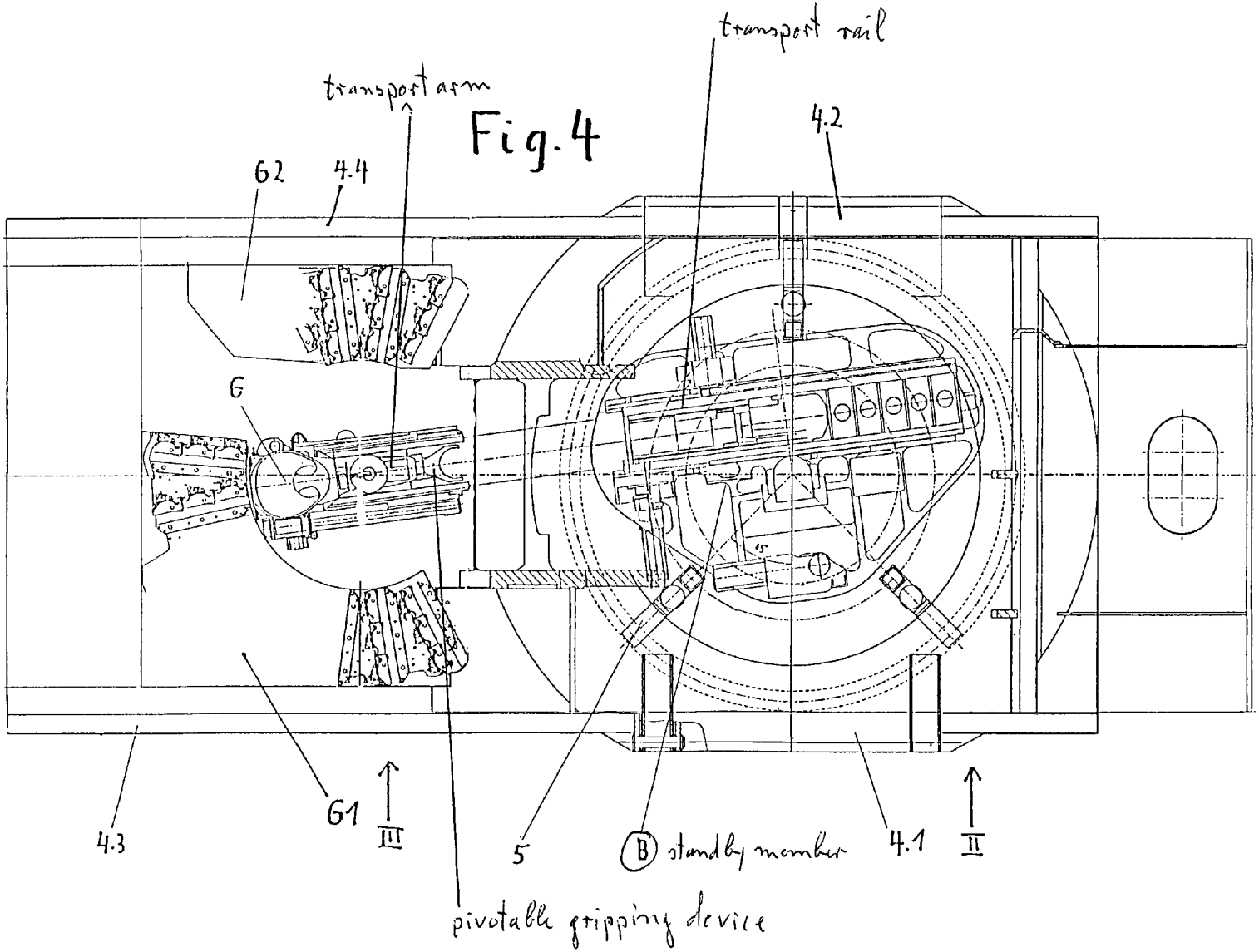
FIG. 4 a plan view of the modules II and III of the embodiment of FIGS. 1 to 3.
Figure 4A:
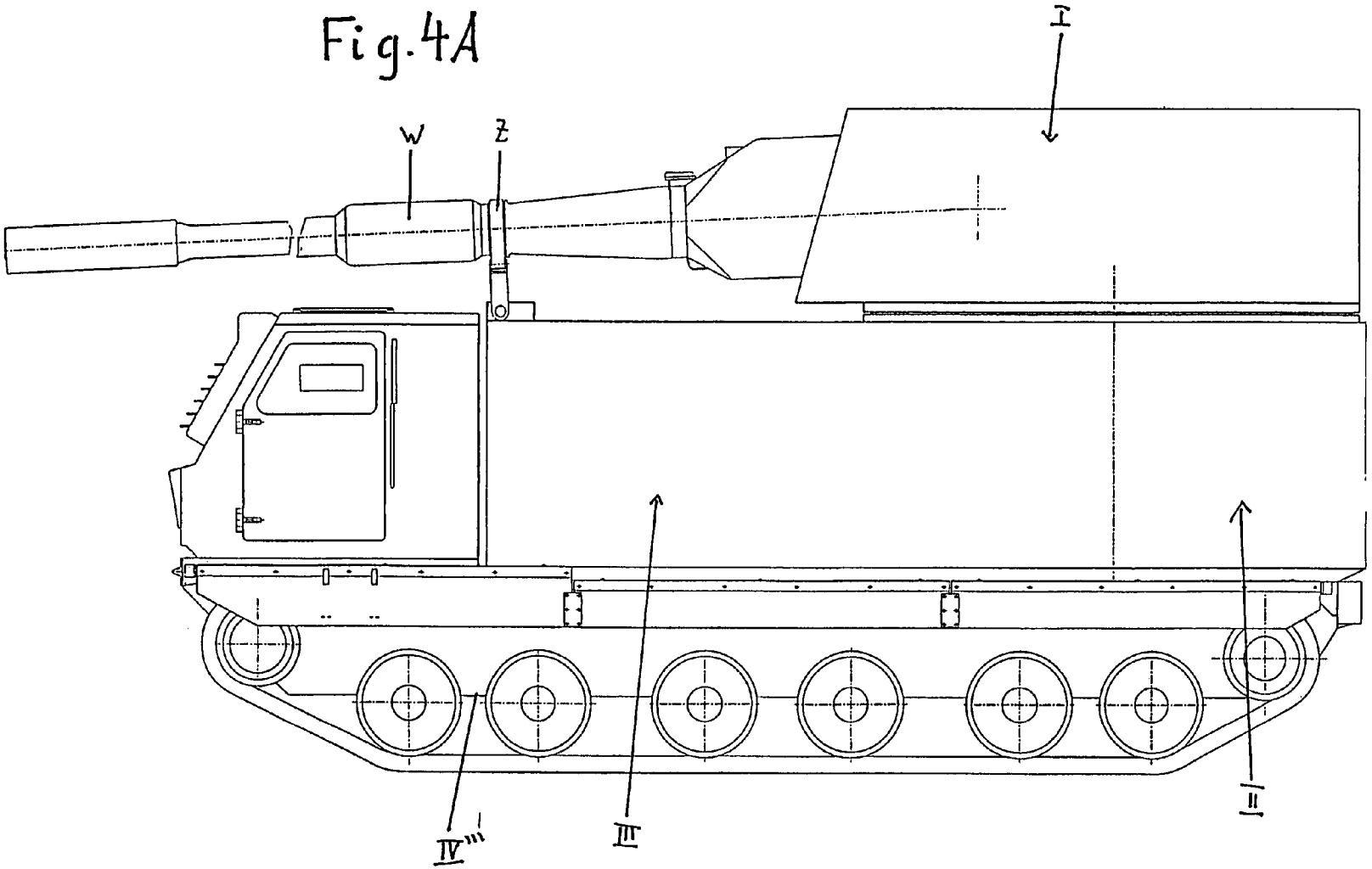
FIG. 4A in an illustration analogous to FIG. 1, the artillery gun of FIGS. 1 to 4 with a chain mechanism.
Figure 5:
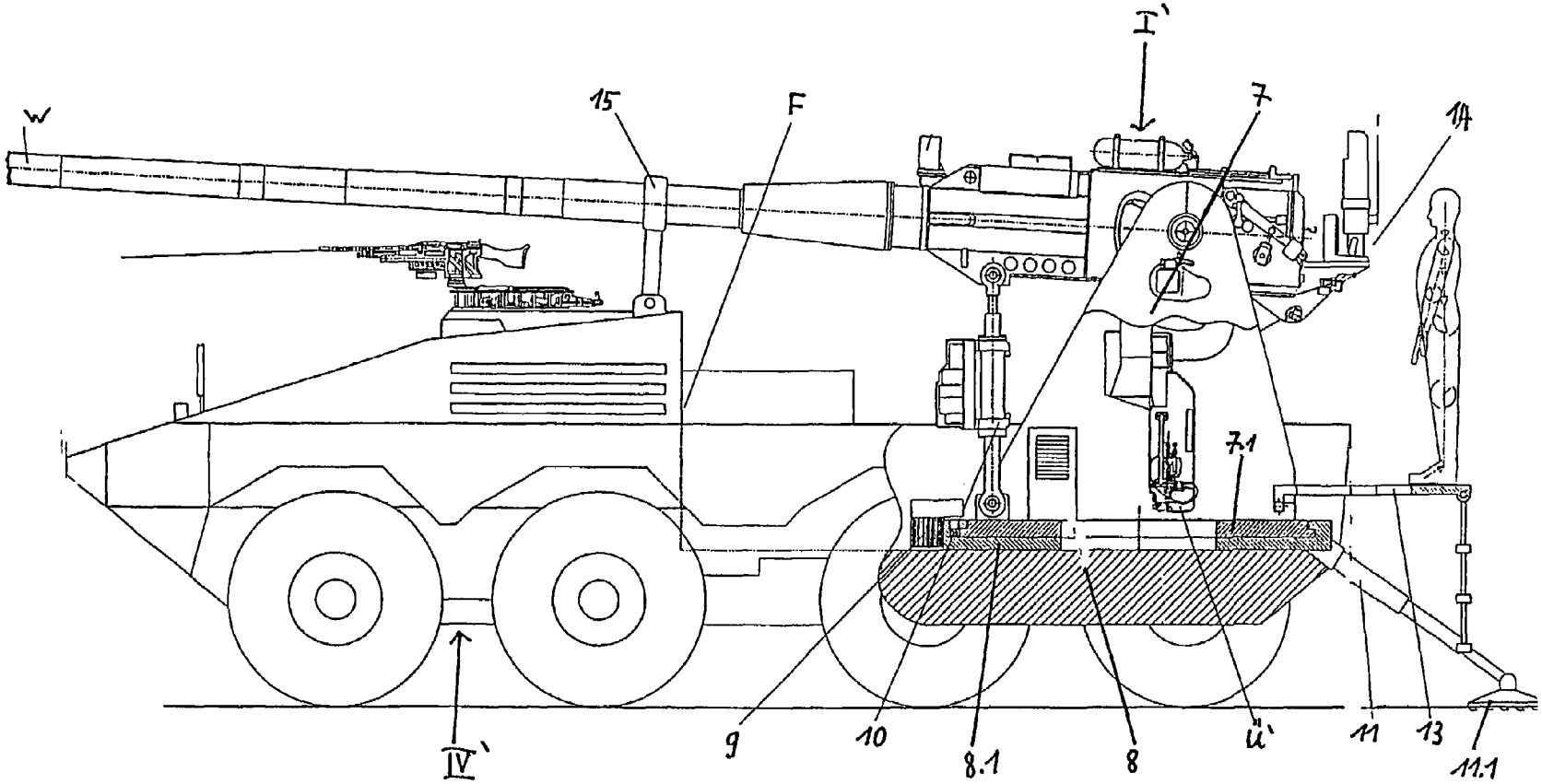
FIG. 5 a side view of a second embodiment of an artillery gun having two modules joined to form a unit.

As illustrated in FIG. 4A, an embodiment of the artillery gun of FIGS. 1 to 4 is also possible where the modules I, II and III are carried by a module IV'" that is embodied as a motor vehicle having a chain mechanism. In this connection, the modules I, II and III can be embodied in the same way as described above, only with the difference that with an embodiment having a chain mechanism a ground support unit is not necessarily required.

The uncoupling and raising of the modules I to III from the module IV, and the loading into an aircraft, can be carried out in a manner similar to a method and via a transport system such as described in EP 0 664 431 B1.

FIGS. 5 to 14 illustrate an embodiment of an artillery gun that, utilizing the same basic principle, undertakes the division of the modules in a somewhat different manner. Here, on the one hand a module I' that accommodates the weapon, and a module IV' that is embodied as a carrier vehicle, are combined to form a first unit, which is illustrated in FIGS. 5 to 9, and furthermore the module II', which contains components of the projectile feed mechanism, as well as the module III', which includes the projectile magazine, are combined, together with a further module V' that is embodied as a carrier vehicle, to form a second unit.

In the transport position, the weapon W can be clamped to the module IV' via a device 15.

Figure 6:
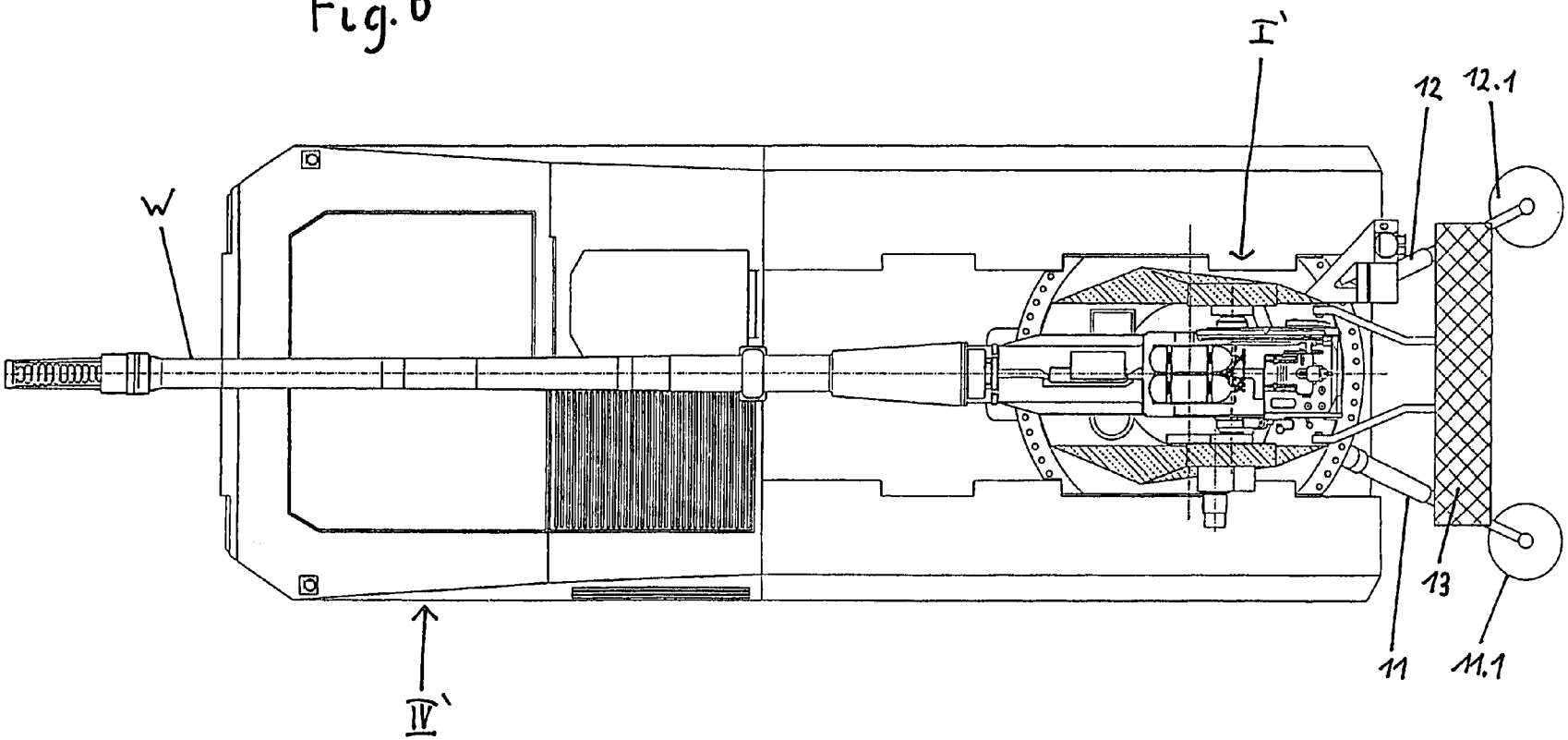
FIG. 6 a plan view of the embodiment of FIG. 5 with the weapon oriented in the longitudinal direction.
Figure 7:
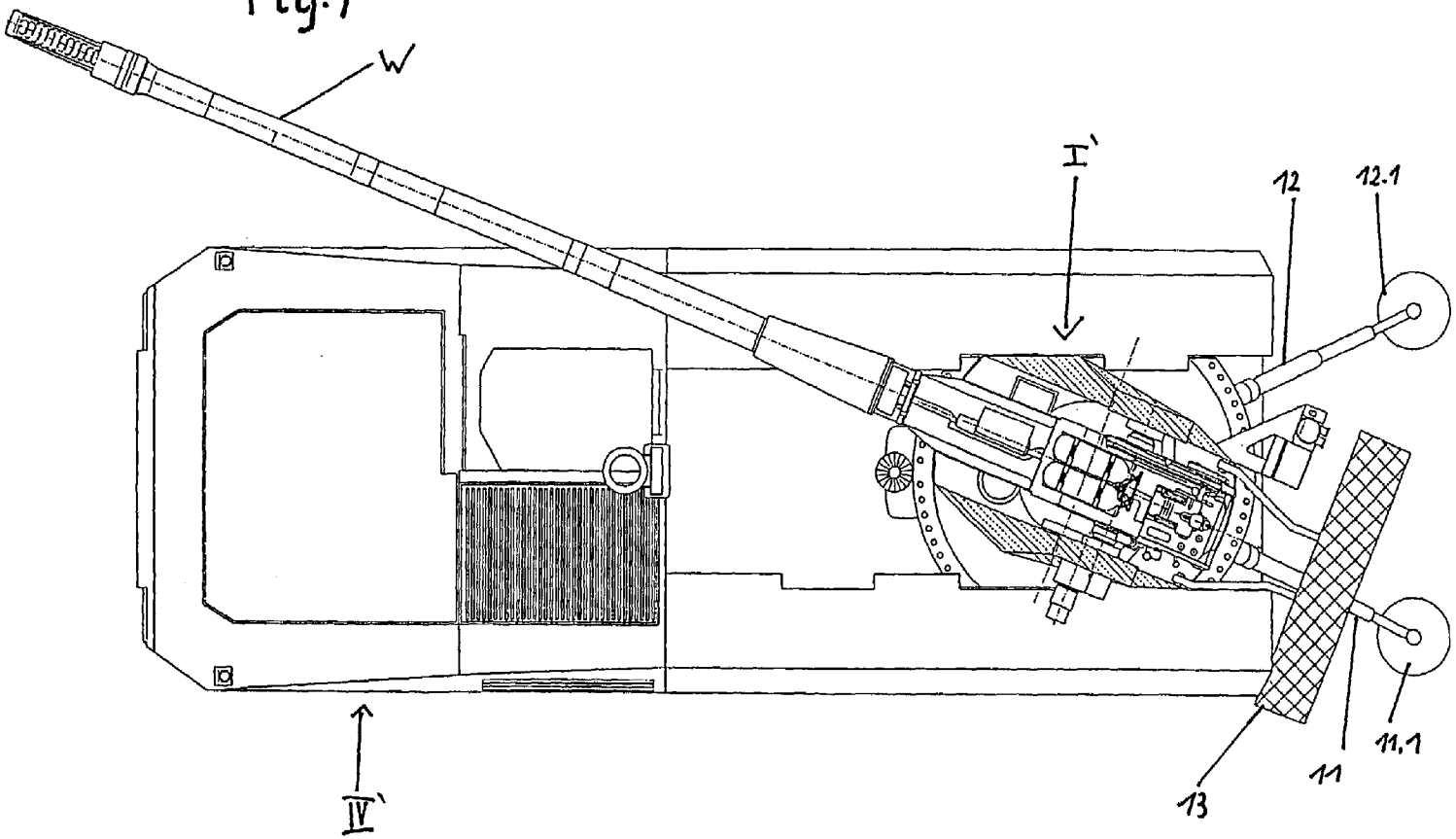
FIG. 7 an illustration analogous to FIG. 6, with a direction of the weapon pivoted by 22° in azimuth.
Figure 8:
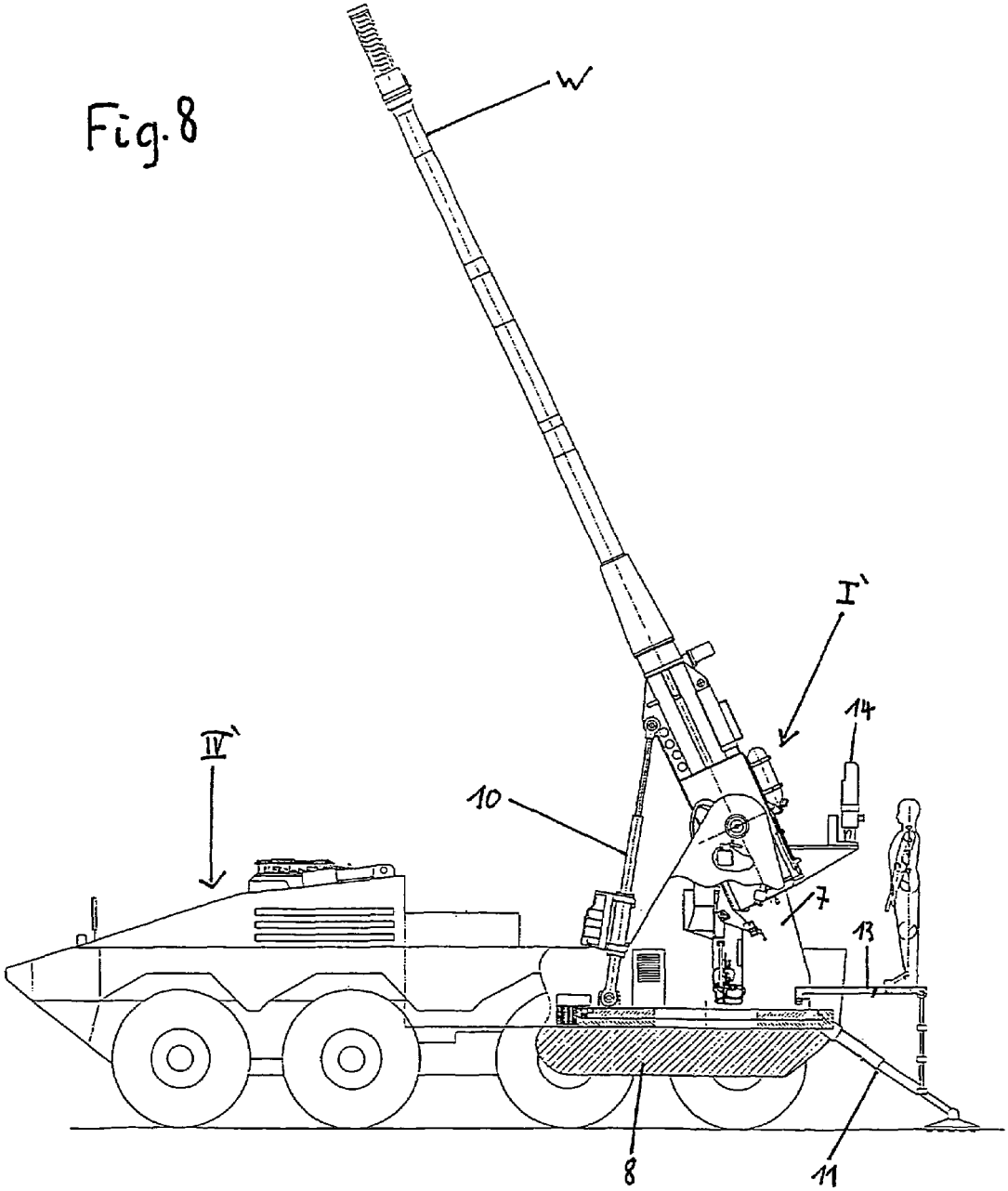
FIG. 8 in an illustration analogous to FIG. 5, the artillery gun with the weapon pivoted up in elevation.
Figure 9:
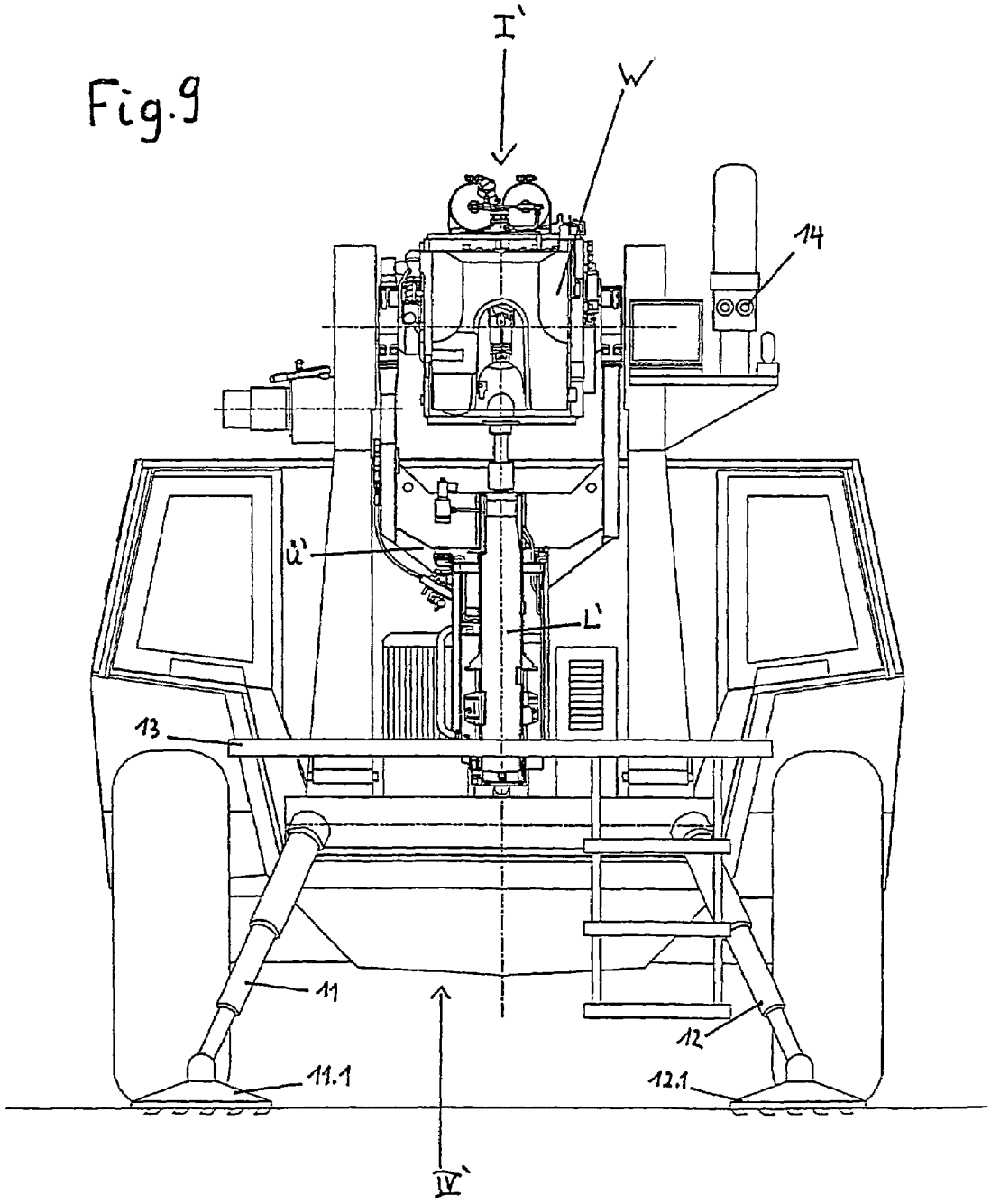
FIG. 9 in an illustration that is slightly enlarged relative to FIG. 5, a view of the embodiment of FIG. 5 from the rear.
Figure 10:
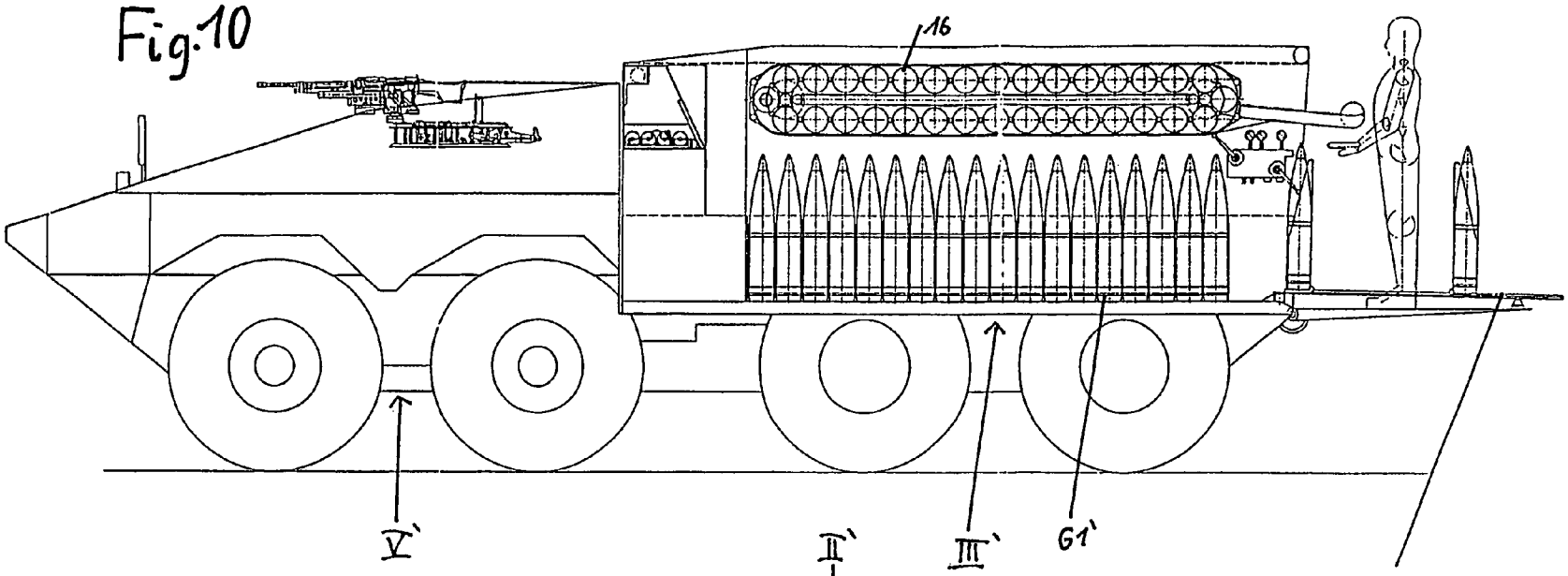
FIG. 10 a side view of the further unit, composed of three modules, belonging to the second embodiment.
Figure 11:
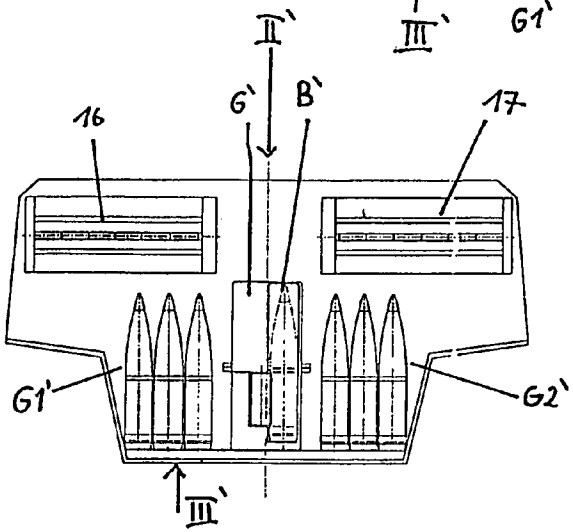
FIG. 11 the modules II' and III' of the unit of FIG. 10 seen from the rear.

The modules IV' and V' are again carrier vehicles that each form a motor vehicle of a known series (GTK) that is embodied as a wheeled vehicle having four axles. With the first variant of the first unit of this embodiment illustrated in FIGS. 5 to 9, the module I' has an upper gun mount 7 on which the weapon W is supported so as to be pivotable in elevation. The upper gun mount 7 has a base plate 7.1 that is rotatably disposed on the counter plate 8.1 of a lower gun mount 8. A traversing gear or drive mount rotates the base plate 7.1 relative to the counter plate 8.1 for the azimuthal adjustment of the weapon W. The elevating movement of the weapon W is effected by means of an elevating mechanism 10. FIG. 6 shows the gun with the weapon W oriented in the longitudinal direction of the vehicle, FIG. 7 shows an orientation with an azimuthal angle offset relative to the longitudinal direction, and FIG. 8 shows a prescribed elevation.

Figure 12:
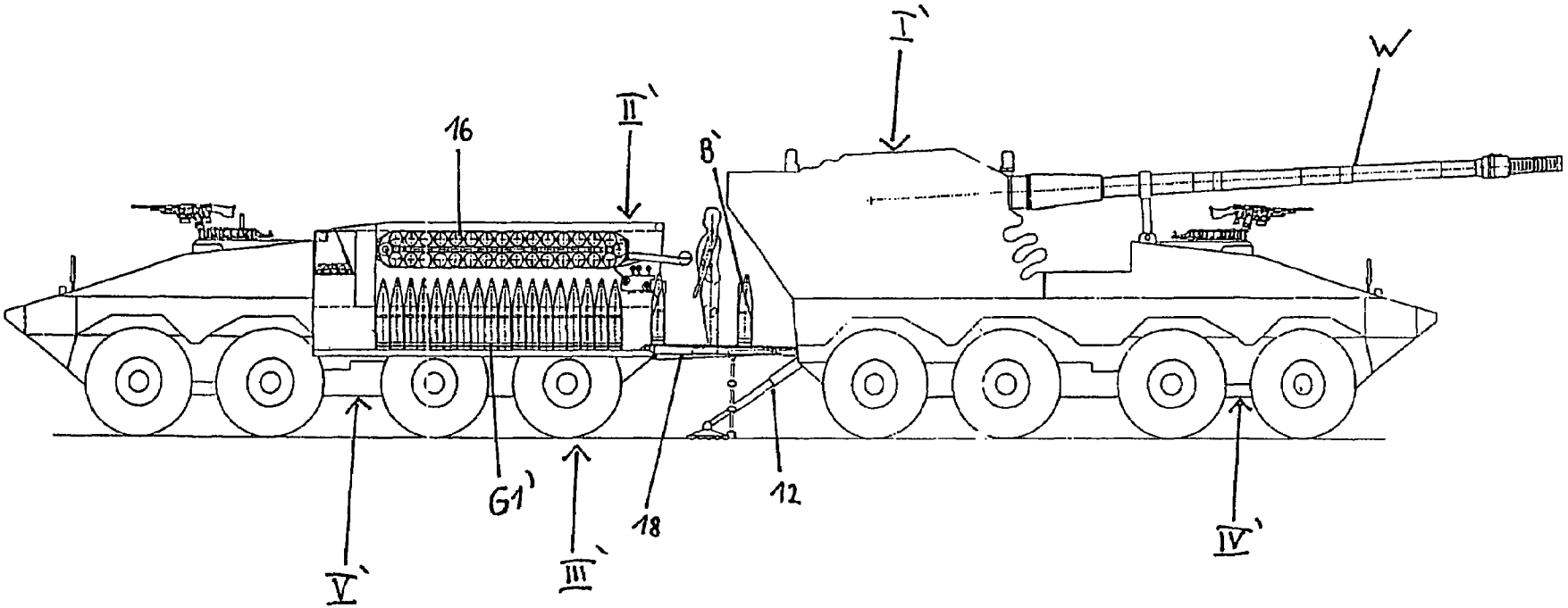
FIG. 12 a side view of the two coupled together units of the embodiment of FIGS. 5 to 10.

Since with this embodiment the firing operation is effected directly from the vehicle, it is necessary to provide a ground support unit. This unit is disposed in the rear portion. Disposed on the lower gun mount 8 are pivotable support arms 11 and 12 that can be telescopically extended and that at their free ends carry support plates 11.1 and 12.1 and that, as can be seen from the drawings, are extendable toward the rear and can be placed upon the ground via the support plates 11.1 and 12.1. Furthermore, the embodiment is provided with a platform 13 from which the firing operation is carried out and from which also the sighting and control device 14 is operated. This embodiment also has a projectile transfer arm Ü', having a charger L', that is pivotable about the trunnion axis. The feeding of the projectiles and the propellant charges is effected with this embodiment from the second unit illustrated in FIGS. 10 and 11. With this embodiment, the modules II' and III' are joined together in a common housing. The projectile magazines G1' and G2' are disposed on sides of a gangway in which is also arranged a projectile transporter G'. The projectiles are transported in an upright position in a stand-by member B', which is displaceable in the longitudinal direction of the vehicle, via a bridge plate 18 that is disposed at the rear of the vehicle. As shown in FIG. 12, the rear portions of the two units can be coupled to one another, so that the munitions transport can be effected directly via the bridge plate 18 from the module II' to the module I', where the projectiles are transferred to the vertical charger of a lowered projectile transfer arm.

Disposed above the projectile magazines G1' and G2' in the module III' are band magazines 16 and 17 for accommodating propellant charges.

Figure 13:
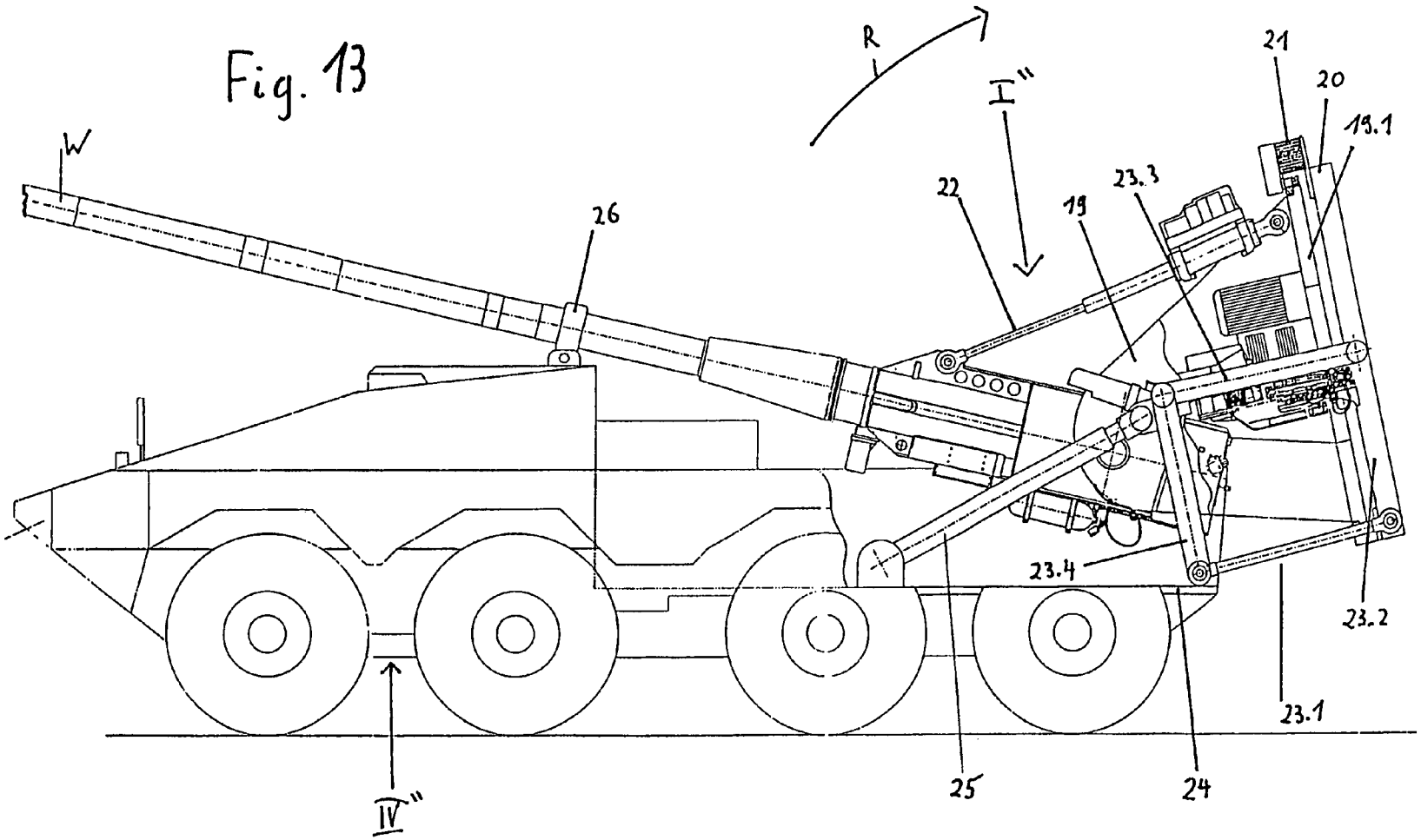
FIG. 13 in an illustration analogous to FIG. 6, a variant of the second embodiment with the weapon pivotable down onto the ground.
Figure 14:
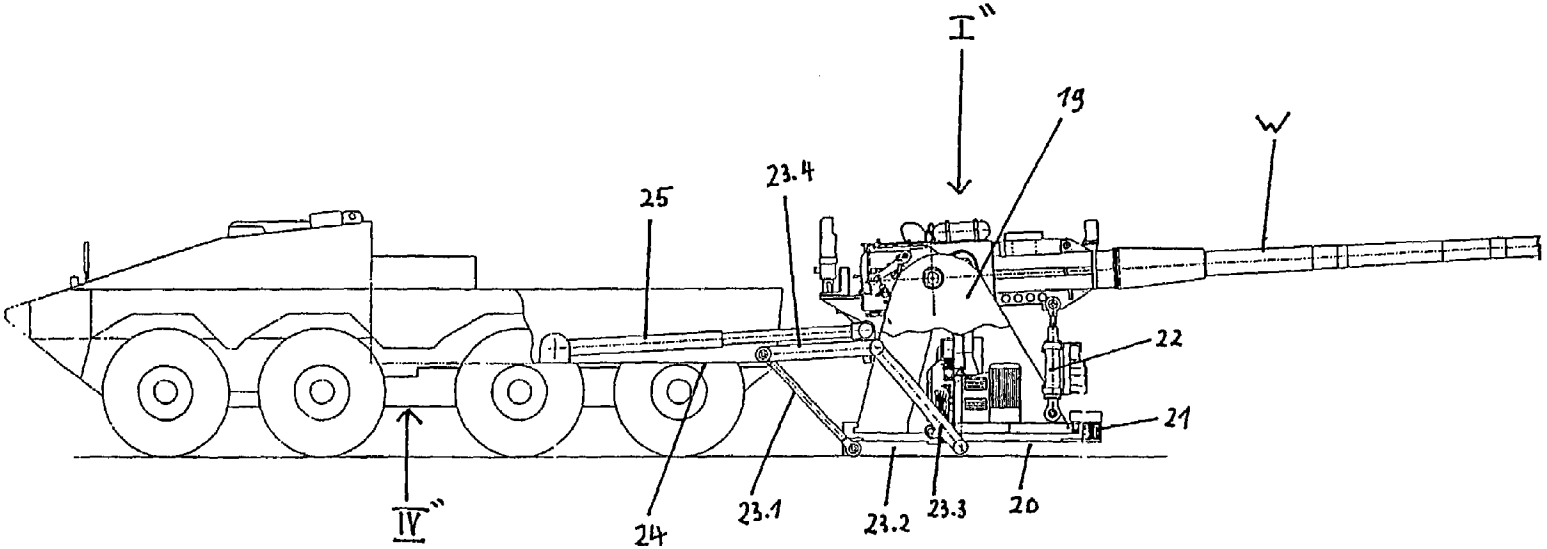
FIG. 14 in an illustration analogous to FIG. 13, the variant of the embodiment with the weapon pivoted down onto the ground.

Illustrated in FIGS. 13 and 14 is a variant of the first unit of FIGS. 5 to 9 where the firing operation is not effected from the vehicle. The module I" that accommodates the weapon, and the module IV" that forms the carrier vehicle, are again joined together to form a first unit. The unit illustrated in FIGS. 10 and 11 can serve as the second unit.

FIG. 13 shows the first unit in an actual transport position, in which a firing operation is not possible. As can be seen from FIG. 13, the module I", with maximum elevation of the weapon W, is disposed in the rear portion of the carrier vehicle in such a way that the upper side of this module faces the carrier vehicle. The module I" again has an upper gun mount 19, on which is supported the weapon W, which is pivotable in elevation, as well as a base frame 20 that forms the lower gun mount and on which is rotatably mounted the base plate 19.1 of the upper gun mount. The rotation is effected via a traversing gear or drive 21. In addition, disposed between upper gun mount 19 and weapon W is the elevating mechanism 22. The base frame 20 is coupled with a chassis 24 of module IV", in other words the carrier vehicle, via laterally disposed link quadrangles that are comprised of the pivotably interconnected elements 23.1, 23.2 (part of the base frame), 23.3 and 23.4. In this connection, the element 23.4 acts as a pivot arm at which respective hydraulic cylinders 25 engage, while the elements 23.1 and 23.3 form a parallel guidance. When the hydraulic cylinder 25 is extended, the entire module I" is pivoted away from the module IV" in the direction of the arrow R until it arrives in the position illustrated in FIG. 14, in which the upper gun mount 19, and hence the weapon W, is placed upon the ground via the base frame 20 behind the rear portion of the carrier vehicle. When being pivoted back, the base frame 20 is raised from the firing position via the hydraulic cylinder 25 and is pivoted toward the front about an angle of more than 90° until the module I" is deposited upon the module IV", the carrier vehicle. In the transport position illustrated in FIG. 13, the weapon W is connected with the module IV" via a clamping device 26.

The specification incorporates by reference the disclosure of German priority document 101 42 565.1 filed Aug. 30, 2001 and PCT/DE02/03047 filed Aug. 21, 2002.

The present invention is, of course, in no way restricted to the specific disclosure of the specification and drawings, but also encompasses any modifications within the scope of the appended claims.

The invention claimed is:

1. An artillery gun having a heavy weapon disposed on a carrier vehicle and comprised of a plurality of modules that are at least partly separable from one another and at least partly combinable with one another, including:

a first module, which contains the weapon, which is mounted on a gun mount so as to be pivotable in elevation and rotatable in azimuth, and also contains at least a portion of an automatic projectile feed mechanism, wherein said first module includes a projectile transfer arm that is pivotably mounted on a trunnion of said weapon and is moveable, independently of said weapon, in or parallel to a plane of elevation of said weapon, wherein disposed on a free end of said projectile transfer arm, in a region rearwardly of said weapon, are a charger and a ramming device, wherein in a raised position of said projectile transfer arm, said charger is aligned with an axis of a bore of said weapon, and in a lowered position of said projectile transfer arm is oriented vertically;

a second module that contains further portions of the automatic projectile feed mechanism including a projectile transporter having a transport arm on an end of which is disposed a pivotable gripping device, and a standby member that is disposed rearwardly of said projectile transporter, wherein said standby member is displaceably guided in a transport rail and is adapted to be disposed in a transfer position parallel to said charger;

a third module that is embodied as a munitions magazine in which projectiles are stored upright such that a respective projectile is adapted to be grasped out of said munitions magazine via said projectile transporter and, accompanied by rotation and orientation, to be conveyed via said standby member and said charger into a region rearwardly of an end of said weapon and to be raised into a loading position;

at least one fourth module that forms the carrier vehicle, wherein said carrier vehicle represents a motor vehicle embodied as a wheeled vehicle having at least three axles, and wherein said first and fourth modules are connected to form a common first unit, and a fifth module forming a further carrier vehicle and corresponding in construction to said fourth module, and wherein said second and third modules are connected with said fifth module to form a common second unit that is independent of said first unit.

2. An artillery gun according to claim 1, wherein with said first unit, said first module, in a transport position having minimal elevation of said weapon, is disposed in a rear portion of said carrier vehicle, and wherein in this rear portion at least one ground support unit is provided that can be extended downwardly.

3. An artillery gun according to claim 2, wherein at least one magazine for propellant charges is disposed in said second and third modules over said munitions magazine.

4. An artillery gun according to claim 1, wherein for a firing operation said fourth and fifth modules are adapted to have facing rear portions thereof coupled together, and wherein a bridge element is provided between said two rear portions.

5. An artillery gun according to claim 4, wherein said bridge element is embodied as a rear gate of said fifth module.

6. An artillery gun according to claim 1, wherein in a transport position said weapon is adapted to be clamped to said carrier vehicle.

* * * * *

UNITED STATES PATENT AND TRADEMARK OFFICE

CERTIFICATE OF CORRECTION

PATENT NO. : 7,111,544 B2
APPLICATION NO. : 10/488409
DATED : September 26, 2006
INVENTOR(S) : Kohlstedt et al.

It is certified that error appears in the above-identified patent and that said Letters Patent is hereby corrected as shown below:

Title page,
Item [54] should read as follows:

[54] ARTILLERY GUN HAVING A HEAVY WEAPON DISPOSED ON A CARRIER VEHICLE

Signed and Sealed this

Twelfth Day of December, 2006

JON W. DUDAS
*Director of the United States Patent and Trademark Office*